United States Patent [19]

Gaisch et al.

[11] Patent Number: 4,524,786

[45] Date of Patent: Jun. 25, 1985

[54] CONTINUOUS PROCESS FOR MICROBIAL DEGRADATION OF TOBACCO CONSTITUENTS CONTAINING NITRATES

[75] Inventors: Helmut Gaisch, Cormondreche; Dieter Schulthess, Neuchatel, both of Switzerland

[73] Assignee: Fabriques De Tabac Reunies S.A., Neuchatel, Switzerland

[21] Appl. No.: 416,769

[22] Filed: Sep. 9, 1982

[30] Foreign Application Priority Data

Sep. 12, 1981 [DE] Fed. Rep. of Germany ..... 3136299

[51] Int. Cl.[3] ..... A24B 15/20

[52] U.S. Cl. ..... 131/308; 131/247

[58] Field of Search ..... 131/308, 309, 310, 297, 131/298

[56] References Cited

U.S. PATENT DOCUMENTS 4,135,521 1/1979 Malan et al. ..... 131/309

4,308,877 1/1982 Mattina ..... 131/297

*Primary Examiner*—V. Millin

*Attorney, Agent, or Firm*—Arthur I. Palmer, Jr.; James F. Haley, Jr.; Margaret A. Pierri

[57] ABSTRACT

Microbial degradation of nitrates in a tobacco extract takes place in a first fermenter under exponential growth conditions of the micro-organisms employed and subsequently in a second fermenter under stationary growth conditions of the degrading micro-organisms. In the first fermenter, carbohydrates are added, while in the second fermenter the depot carbohydrates which the micro-organisms have stored in the first fermenter are utilized.

11 Claims, 1 Drawing Figure

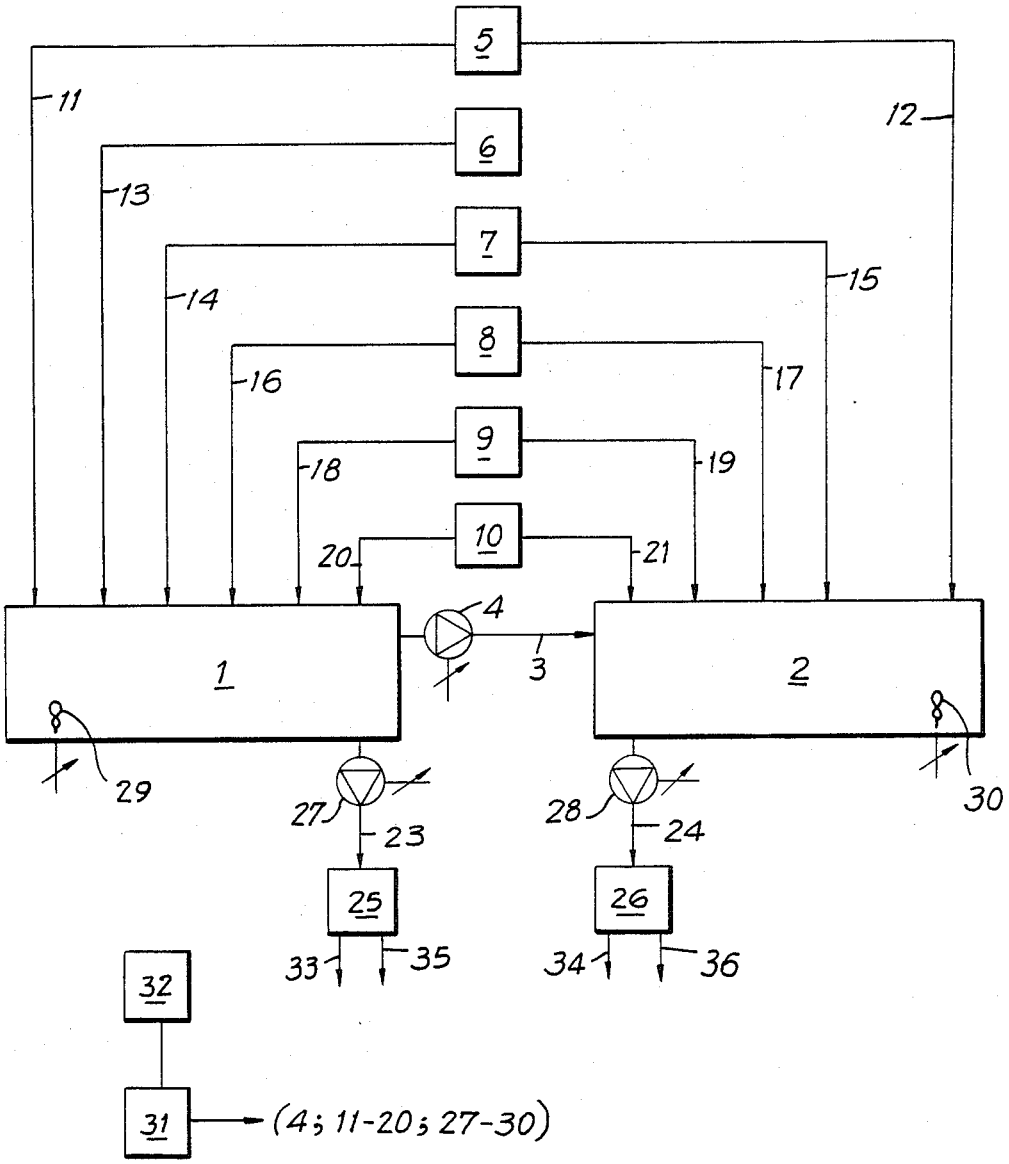
5
6
7
8
9
10
11
12
13
14
15
16
17
18
19
20
21
4
3
1
2
29
30
27
28
23
24
25
26
33
35
34
36
32
31
(4; 11-20; 27-30)

CONTINUOUS PROCESS FOR MICROBIAL DEGRADATION OF TOBACCO CONSTITUENTS CONTAINING NITRATES

TECHNICAL FIELD

The invention relates to a continuous process for the microbial degradation of tobacco constituents, containing nitrates, nitrites and ammonium. In such a process, a fresh aqueous tobacco extract is introduced continuously into a fermenter in which exponential growth conditions for the micro-organisms are maintained, and treated extract is removed.

DISCLOSURE OF THE INVENTION

In the exponential growth phase of micro-organisms, in which the biomass multiplies in accordance with an exponential function, the micro-organisms take up excess carbohydrates and utilize them to form reserve depots. These reserve depots cannot be utilized for the desired microbial degradation during the exponential growth phase. In the stationary phase, however, that is to say under conditions in which the biomass just maintains its level, these reserve depots can be utilized, but only at the cost of very slow progress of the desired microbial degradation.

It is an object of the present invention to provide a process of the above-mentioned type in which not only is the degradation rate high, but the depot losses are nevertheless reduced or diminished.

In accordance with this invention, this is achieved by a process wherein carbohydrate taken up by the biomass removed with the treated extract from a first fermenter is used in a second fermenter to treat extracted tobacco constituents while the organisms are in the stationary phase, which is maintained by the addition of salts, as necessary, by continuous aeration and by regulating the pH and temperature.

In the first fermenter, a high degradation rate under exponential growth conditions is realized, although depots are formed. These depots are then worked up in the second fermenter, under stationary conditions.

If a degradation balance for the two steps together is drawn up, it is found that a very high degradation rate is attainable without unacceptable depot losses.

The biomass which is still present in the extract when its treatment is finished no longer contains any depots and is advantageously separated from the treated tobacco extract before the denitrated tobacco extract is advanced for further processing.

In order to ensure an advantageous balance of degradation rate it is advisable that the extract to be treated in the second fermenter, due to the microbial pretreatment in the first fermenter, should contain a lower concentration, based on solids, of the constituents to be degraded than the original treated extract.

Such an extract for the second fermenter can be obtained if, in the first fermenter, the nitrate-nitrogen content of the tobacco constituents is completely degraded. The extract thus treated is mixed, preferably in a ratio of 5:1 to 1:5, with untreated extract and the resulting and mixed extract thus obtained is treated in the second fermenter, or, alternatively, in the first fermenter, the nitrate-nitrogen content of the tobacco constituents is degraded incompletely and the extract thus treated, or such extract mixed in a dilution of up to 1:5 with untreated extract is treated in the second fermenter.

Advantageous conditions for the first stage of fermentation are attained if an extract having a nitrate-nitrogen concentration of 0.6 to 1.7 $g.l^{-1}$, a phosphate concentration of 1.0 to 10 $g.l^{-1}$ and a carbon source concentration of 16.5±10 assimilable carbon atoms per nitrate molecule is supplied continuously to the first fermenter at a dilution rate of 0.1 to 0.35 $l.l^{-1}.\ h^{-1}$ while exponential growth conditions for the degrading micro-organisms are maintained by aeration with 0.8 to 2.5 $l.l^{-1}.min.^{-1}$, pH adjustment in the range of 3.5 to 6, and warming to a temperature range of 25° to 37° C., with the volume of the contents of the first fermenter being kept constant by continuous removal of treated extract together with the corresponding biomass.

While the first fermenter, for reasons of streamlined industrial production, is operated by a continuous process, the latter is not necessarily the optimum mode of operation of the second fermenter because in the second fermenter, in order to achieve a high balance of degradation rate, less degradation is effected in total than in the first fermenter. Depending on the circumstances, it may be advisable to operate the second fermenter by a continuous process, with continuous introduction and removal of extract with the extract preferably supplied at a dilution rate of 0.05 to 0.35 $l.l^{-1}.h^{-1}$, a batch process or a so-called fed batch process, in which the feed takes place continuously and uniformly and emptying takes place periodically.

The microbial degradation is preferably effected by the use of micro-organisms from the group comprising *Candida utilis* NCYC 707, *Candida berthetii* CBS 5452, *Candida utilis* NCYC 321, *Candida utilis* NCYC 359 and *Enterobacter aerogenes* ATCC 13048, corresponding to DSM 30053.

These strains are obtainable under the stated designation number from the depositories identified by the abbreviations, as follows:

NCYC: National Collection of Yeast Cultures, Brewing Industry Research Foundation;

CBS: Centraal Bureau voor Schimmelcultures;

ATCC: American Type Culture Collection;

DSM: Deutsche Sammlung von Mikroorganismmen.

The description of the strains is to be found in lists I, II and III, which follows. In these "+" means good, "~" means weak and "−" means absent.

LIST I: Characterization of *Candida utilis* NCYC 707, NCYC 359 and NCYC 321 is indicated by the sign in front of the oblique stroke and that of *Candida berthetii* CBS 5452 by the sign behind the oblique stroke. Plasmodium or pseudoplasmodium −/−; mobile cells −/−; ballistospores −/−; monopolar budding −/−; bipolar budding −/−; buds on stems −/−; triangular cells −/−; moon-shaped cells −/−; short-lived cells with slow growth on malt agar and intense production of acetic acid −/−; formation of genuine mycelium −/−; formation of pseudomycelia +/+; cultures red or orange −/−;

Fermentation: glucose +/+; galactose −/−; sucrose +/−; maltose −/−; cellobiose −/−; trehalose −/−; lactose −/−; melibiose −/−; raffinose +/−; melezitose −/−; inulin −/−.

Assimilation: glucose +/+; galactose −/−; L-sorbose −/−; sucrose +/−; maltose +/−; cellobiose +/+; trehalose +,~/−; lactose −/−;melibiose −/−; raffinose +/−; melecitose +/−; inulin +/−; soluble starch −/−; D-xylose +,~/−: L-arabinose −/−; D-arabinose −/−; D-ribose −/−; L-rhamnose −/−; ethanol +,~/+; glycerol +/+; erythrol −/−;

ribitol −/−; galactitol −/−; D-mannitol +,−,~/−; D-glucitol − −; a-methyl-D-glucoside +,~/−; salicin +/+; DL-lactate +/−; succinate +,~/+, ; citrate +/+,~; inositol −/−; assimilation of potassium nitrate +/+; growth in vitamin free medium +,~/+; growth promoting vitamins thiamine/absent; NaCl tolerance % (weight/volume) 6–8/6–7; maximum growth temperature, °C. 39–43/40–41.

LIST II: Characterization of ATCC 13048

Cell shape short rods; flagellae perittrichal; mobility +; sporulation −; pigment −; Gram reaction −; $O_2$ behavior aerobic +; anaerobic +; catalose +; oxidase −; nitrite formation from nitrate +; indole −; methyl red −; Vosges Proskauer test +; citrate +; $H_2S$ −; urease −; gelatine −; lysine decarboxylase +; arginine dihydrolase −; ornithine decarboxylase +; phenylalanine desaminase −; malonate +; gas from glucose +; lactose +; lactose +; sucrose +; mannitol +; dulcitol −; salicin +; adonitol +; inositol +; sorbital +; arabinose +; raffinose +; rhamnose +.

The invention will now be described in more detail with reference to the accompanying drawings and to some examples.

BRIEF DESCRIPTION OF THE DRAWINGS

The drawing represents a generized flow diagram for the process according to the invention.

MODES FOR CARRYING OUT THE INVENTION

In the drawing, a first fermenter 1, which is operated in the exponential growth phase of the micro-organisms and a second fermenter 2, which is operated in the stationary phase of the micro-organisms, are conencted by a transfer line 3 fitted with a controllable metering pump 4. A tobacco extract feed tank 5 containing aqueous tobacco extract to be treated, a carbohydrate feed tank 6 containing aqueous carbohydrate solution, a salt feed tank 7 containing aqueous salt solution, and a ph stabilizer 8 containing salt solution for stabilizing the pH are connected to the respective fermenters by feed lines 11 to 17, which feed in the direction of the arrows shown, more especially in metered flow, impelled and controlled by metering pumps (not shown). The lines 16 and 17 also include measuring means for monitoring the pH in the associated fermenter, and for feedback of the results of such measurements to a regulator on the pH stabilizer 8, which thereupon maintains constant the selected pH in the respective fermenter by supplying an appropriate amount of the salt solution. An aerotor 9, including a compressor is connected to the fermenters by aeration lines 18, 19. A thermostatic heating control 10 is connected to the fermenters by lines 20 and 21 which include heating connections and connections to thermocouples disposed in the fermenters, which thus control the thermostat 10 to vary the heat input through the lines 20, 21 so that a preselected temperature can be maintained in the respective fermenter. The supplies of tobacco extract, carbohydrate and salts can be preselected by adjustable controls at the tanks 5, 6, 7. Correspondingly, the pH, the aeration rate and the temperature can also be separately preselected for the two fermenters, by means of controls on the respective units 8, 9, 10. The fermenters 1 and 2 are respectively connected through lines 23, 24 to separators 25, 26 for separating the biomass from the extract. Metering pumps 27, 28 in the lines 23 and 24 enable the flow rates in these lines to be preselected. Both fermenters are equipped with circulating devices 29, 30, whose operation can be preselected by appropriate controls. All the controls can be set either manually or from a central control apparatus 31, which in turn can be driven by a programming unit 32. The course of the program depends on measurements, emanating from measuring probes (not shown), which monitor the course of the process.

Transfer through the line 3 of the biomass contained in the pretreated extract, or of the separated biomass from the separator 25, takes place rapidly, so that the biomass is still in its stationary phase when it enters the fermenter. The biomass in the treated extract which is withdrawn through lines 23 and 24 is separated off in the separators 25 and 26 respectively. The extracts thus purified are fed through lines 33 and 34 respectively to further processing stages, while the biomass is discharged through lines 35 and 36 respectively.

EXAMPLES

In the examples which follow, operation in steady running is described in each case. The plant is started up by appropriately filling the fermenter and by appropriate pretreatment, so that a steady running condition is reached as soon as possible. The operating data for the individual examples are shown in Table 1 below, in which the tabulated items relate to the various stages as follows:

Items 1–11:

Supply of tobacco extract and additives to the fermenter 1 through the lines 11, 13 and 14, and associated pH, aeration and temperature control through lines 16, 18 and 20.

Items 12–16:

Treated or pretreated tobacco extract removed from fermenter 1.

Items 17–27:

Supply of tobacco extract and additives to the fermenter 2 through the lines 3, 12, 15 and 35, and pH, aeration and temperature control through lines 17, 19 and 21.

Items 28–30:

Discharge of finally treated tobacco extract from the second fermenter 2.

Items 31–34:

Assessment of the overall degradation balance.

TABLE I

| Item (below) | Example: 1 | 2 | 3 | 4 | 5 | 6 | 7 |
|---|---|---|---|---|---|---|---|
| 1 pH value raised by | KOH | | | | | | |
| 2 pH-value reduced by | Citric acid | | | | | 90% Lactic + 10% Phosphoric acid | |
| 3 Carbohydrate source | Glucose | | | | | | |
| 4 Micro-organisms | *Candida utilis* NCYC 707 | | | | | | |
| 5 Nitrate-nitrogen concentration, $g \cdot l^{-1}$ | 2 | 1 | 0.5 | 0.5 | 0.5 | 1 | 1 |
| 6 Phosphate concentration | 1.25 | 1.25 | 1.25 | 1.25 | 1.25 | 0.3 | 0.3 |

TABLE I-continued

| | | | | | | | |
|---|---|---|---|---|---|---|---|
| $g \cdot l^{-1}$ | | | | | | | |
| 7 Dilution rate, $l \cdot l^{-1} \cdot h^{-1}$ | 0.13 | 0.13 | 0.13 | 0.13 | 0.13 | 0.24 | 0.13 |
| 8 Carbohydrate addition $g \cdot l^{-1}$ | 74 | 37 | 18.5 | 18.5 | 18.5 | 37 | 37 |
| 9 Selected pH | 5.5 | 5.5 | 5.5 | 4.0 | 6.0 | 5.5 | 5.5 |
| 10 Selected Temperature, °C. | 30 | 30 | 30 | 32 | 25 | 30 | 30 |
| 11 Aeration flow rate $l \cdot l^{-1} \cdot min.^{-1}$ | 1.5 | 1.5 | 1.5 | 1.5 | 2.5 | 1.5 | 1.5 |
| 12 Extract transferred through 3 as % of total extract removed | 100 | 100 | 100 | 100 | 100 | 100 | 100 |
| 13 Extract discharged through line 23 as % of total extract removed | 0 | 0 | 0 | 0 | 0 | 0 | 0 |
| 14 Nitrate-nitrogen concentration $g \cdot l^{-1}$ | 0 | 0 | 0 | 0 | 0 | 0 | 0 |
| 15 Phosphate concentration, $g \cdot l^{-1}$ | 0.1 | 0.5 | 0.8 | 0.8 | 0.8 | 0.3 | 0.3 |
| 16 Free carbohydrate present, $g \cdot l^{-1}$ | 0 | 0 | 0 | 0 | 0 | 0 | 0 |
| 17 pH-value raised by | | | | KOH | | | |
| 18 pH-value reduced by | | | | Phosphoric acid | | | |
| 19 Feed ratio, line 12: line 3 | 1:1 | 1:1 | 1:1 | 1:1 | 1:1 | 1:1 | 1:1 |
| 20 Biomass added from line 35, % (v/v) of feed through line 12 | 0 | 0 | 0 | 0 | 0 | 0 | 0 |
| 21 Nitrate-nitrogen concentration $g \cdot l^{-1}$ | 1 | 0.5 | 0.25 | 0.25 | 0.25 | 0.5 | 0.5 |
| 22 Phosphate concentration, $g \cdot l^{-1}$ | 0.4 | 0.8 | 1.1 | 1.1 | 1.1 | 0.3 | 0.3 |
| 23 Dilution rate, $l \cdot l^{-1} \cdot h^{-1}$ | 0.1 | 0.1 | 0.1 | 0.1 | 0.1 | — | — |
| 24 Selected pH | 5.5 | 5.5 | 5.5 | 5.0 | 4.5 | 5.5 | 5.5 |
| 25 Selected Temperature, °C. | 30 | 30 | 30 | 32 | 28 | 30 | 30 |
| 26 Aeration flow rate, $l \cdot l^{-1} \cdot min.^{-1}$ | 1.5 | 1.5 | 1.5 | 2.5 | 1.0 | 1.5 | 1.5 |
| 27 Residence time in fermenter 2, hours | — | — | — | — | — | 24 | 24 |
| 28 Nitrate-nitrogen concentration, $g \cdot l^{-1}$ | 0.58 | 0.29 | 0.15 | 0.15 | 0.15 | 0.2 | 0.22 |
| 29 Phosphate concentration, $g \cdot l^{-1}$ | 1.0 | 1.1 | 1.5 | 1.5 | 1.7 | 0.7 | 0.6 |
| 30 Free carbohydrate present, $g \cdot l^{-1}$ | 0 | 0 | 0 | 0 | 0 | 0 | 0 |
| 31 Nitrate decomposition balance in both fermenters, $g \cdot l^{-1}$ based on total extract treated | 1.42 | 0.71 | 0.4 | 0.4 | 0.4 | 0.8 | 0.8 |
| 32 Carbohydrate consumption relative to nitrate removed, $g \cdot g^{-1}$ (g. carbohydrate/ g. nitrate-nitrogen) | 26 | 26 | 26 | 26 | 26 | 23 | 24 |
| 33 Nitrate decomposition (compared with untreated extract), % | 71 | 71 | 71 | 71 | 71 | 80 | 78 |
| 34 Sugar saving in second fermentation, % | 21 | 21 | 21 | 21 | 21 | 30 | 28 |

| Item (below) | Example: 8 | 9 | 10 | 11 | 12 | 13 | 14 | 15 |
|---|---|---|---|---|---|---|---|---|
| 1 pH value raised by | | | | | KOH | | | |
| 2 pH-value reduced by | Acetic acid | | 90% Lactic + 10% Phosphoric acid | | | Phosphoric acid | | 90% Lactic + 10% Phosphoric acid |
| 3 Carbohydrate source | | | | | Glucose | | | |
| 4 Micro-organisms | | | | | *Candida utilis* NCYC 707 | | | |
| 5 Nitrate-nitrogen concentration, $g \cdot l^{-1}$ | 0.5 | 0.5 | 0.5 | 0.5 | 1 | 1 | 1 | 0.5 |
| 6 Phosphate concentration $g \cdot l^{-1}$ | 1.25 | 1.25 | 0.3 | 0.3 | 0.3 | 0.3 | 0.3 | 0.3 |
| 7 Dilution rate, $l \cdot l^{-1} \cdot h^{-1}$ | 0.24 | 0.24 | 0.24 | 0.3 | 0.24 | 0.24 | 0.13 | 0.3 |
| 8 Carbohydrate addition $g \cdot l^{-1}$ | 18.5 | 18.5 | 18.5 | 18.5 | 37 | 37 | 18.5 | 18.5 |
| 9 Selected pH | 5.5 | 5.5 | 5.5 | 5.5 | 5.5 | 5.5 | 5.5 | 5.5 |
| 10 Selected Temperature, °C. | 30 | 30 | 30 | 30 | 30 | 30 | 30 | 30 |
| 11 Aeration flow rate $l \cdot l^{-1} \cdot min.^{-1}$ | 1.5 | 1.5 | 1.5 | 1.5 | 1.5 | 1.5 | 1.5 | 1.5 |
| 12 Extract transferred through 3 as % of total extract removed | 100 | 100 | 100 | 100 | 0 | 0 | 100 | — |

TABLE I-continued

| | | | | | | | | | |
|---|---|---|---|---|---|---|---|---|---|
| 13 | Extract discharged through line 23 as % of total extract removed | 0 | 0 | 0 | 0 | 100 | 100 | 0 | 100 |
| 14 | Nitrate-nitrogen concentration $g \cdot l^{-1}$ | 0 | 0 | 0 | 0 | 0 | 0 | 0.5 | 0 |
| 15 | Phosphate concentration, $g \cdot l^{-1}$ | 0.8 | 0.8 | 0.2 | 0.2 | 0.3 | 6.0 | 6.0 | 0.2 |
| 16 | Free carbohydrate present, $g \cdot l^{-1}$ | 0 | 0 | 0 | 0 | 0 | 0 | 0 | 0 |
| 17 | pH-value raised by | | | | KOH | | | | — |
| 18 | pH-value reduced by | | | | Phosphoric acid | | | | — |
| 19 | Feed ratio, line 12: line 3 | 1:1 | 3:1 | 1:3 | 1:1 | 1:0 | 1:0 | 0:1 | — |
| 20 | Biomass added from line 35, % (v/v) of feed through line 12 | 0 | 0 | 0 | 0 | 20 | 20 | 0 | — |
| 21 | Nitrate-nitrogen concentration $g \cdot l^{-1}$ | 0.25 | 0.38 | 0.13 | 0.25 | 0.83 | 0.83 | 0.5 | — |
| 22 | Phosphate concentration, $g \cdot l^{-1}$ | 1.1 | 1.1 | 0.3 | 0.3 | 0.3 | 6.0 | 6.0 | — |
| 23 | Dilution rate, $l \cdot l^{-1} \cdot h^{-1}$ | 0.1 | 0.1 | 0.1 | 0.05 | 0.1 | 0.1 | 0.1 | — |
| 24 | Selected pH | 5.5 | 5.5 | 5.5 | 5.5 | 5.5 | 5.5 | 5.5 | — |
| 25 | Selected Temperature, °C. | 30 | 30 | 30 | 30 | 30 | 30 | 30 | — |
| 26 | Aeration flow rate, $l \cdot l^{-1} \cdot min.^{-1}$ | 1.5 | 1.5 | 1.5 | 1.5 | 1.5 | 1.5 | 1.5 | — |
| 27 | Residence time in fermenter 2, hours | — | — | — | — | — | — | — | — |
| 28 | Nitrate-nitrogen concentration, $g \cdot l^{-1}$ | 0.15 | 0.36 | 0.05 | 0.15 | 0.48 | 0.46 | 0.4 | — |
| 29 | Phosphate concentration, $g \cdot l^{-1}$ | 1.5 | 1.1 | 0.8 | 0.6 | 0.5 | 7.0 | 7.0 | — |
| 30 | Free carbohydrate present, $g \cdot l^{-1}$ | 0 | 0 | 0 | 0 | 0 | 0 | 0 | — |
| 31 | Nitrate decomposition balance in both fermenters, $g \cdot l^{-1}$ based on total extract treated | 0.33 | 0.15 | 0.45 | 0.35 | 0.71 | 0.73 | 0.6 | — |
| 32 | Carbohydrate consumption relative to nitrate removed, $g \cdot g^{-1}$ (g. carbohydrate/ g. nitrate-nitrogen) | 28 | 31 | 31 | 26 | 26 | 25 | 30 | 37 |
| 33 | Nitrate decomposition (compared with untreated extract), % | 66 | 28 | 89 | 70 | 71 | 73 | 60 | 100 |
| 34 | Sugar saving in second fermentation, % | 16 | 3 | 14 | 20 | 21 | 23 | 10 | — |

In Examples 1 to 5, the tobacco constituents containing nitrates, nitrites and ammonium ions are completely degraded in the first fermenter. The treated extract, together with the corresponding biomass, passes continuously into the fermenter 2 where it is mixed with untreated tobacco extract from the feed tank 5. In the mixed extract, the nitrates and ammonium compounds are degraded microbially, using the depot carbohydrates. The fermenter 2 is also operated on a continuous basis.

In Examples 6 and 7 the tobacco constituents containing nitrates, nitrites and ammonium ions are completely degraded in the first fermenter. The treated extract, together with the corresponding biomass, passes continuously to the fermenter 2 and is there mixed with untreated tobacco extract from the feed tank 5. In the mixed extract, the nitrates, nitrites and ammonium compounds are degraded microbially, using the depot glucose. In these Examples the fermenter 2 is operated batchwise. For this purpose, one fermenter is filled and is then replaced by another fermenter which is subsequently filled. While one fermenter 2 is being filled, the other is full and is left to stand for 24 hours, during which the aeration, pH setting and temperature setting are maintained. After 24 hours, the desired degradation has taken place and the extract is discharged through the line 24, after which the fermenter 2 can be recharged.

In Examples 8 to 11, the tobacco constituents containing nitrates, nitrites and ammonium ions are completely degraded in the first fermenter. The treated tobacco extract, together with the corresponding biomass, passes continuously to the fermente 2 and is there mixed with untreated extract from the feed tank 5. In the mixed extract, the nitrates, nitrites and ammonium compounds are degraded microbially, using the depot glucose. The fermenter 2 is operated on the so-called fed batch principle and, for this purpose, is slowly filled with extract by a constant uniform feed and, as soon as it has been filled, it is emptied rapidly and completely through the line 24, and then slowly filled again.

In Examples 12 and 13, nothing passes into the fermenter 2 through the line 3. Instead, the separated biomass obtained from the line 35 is introduced into the fermenter 2. In Example 12 the fermenter 2 is operated on a continuous principle and in Example 13 it is operated on the fed-batch principle.

In Example 14, the tobacco constituents containing nitrates, nitrites and ammonium ions are not completely degraded in the first fermenter. The treated extract is transferred into fermenter 2. There, an additional amount of nitrate, nitrite and ammonia is degraded. The second fermenter is also run on a continuous basis.

In comparative Example 15, the second fermenter does not participate; microbial degradation is carried out only in the first fermenter, under exponential growth conditions; this, however, means accepting depot losses ofcarbohydrates.

We claim:

1. A continuous process for the microbial degradation of tobacco constituents containing nitrates, nitrites and ammonium ions, wherein fresh aqueous tobacco extract is added continuously to a first fermenter in which exponential growth conditions for the micro-organisms are maintained, and treated extract is continuously removed, characterized in that excess carbohydrate taken up by the biomass removed with the treated extract is used in a second fermenter for the degradation of a further extract of tobacco constituents with the biomass in its stationary phase, the stationary condition being maintained by addition of salts, where necessary, by continuous aeration and by regulating the pH and temperature.

2. The process according to claim 1 characterised in that the extract introduced into the second fermenter contains a lower concentration, based on dry solids, of the constituents to be degraded than does the untreated extract, as a result of microbial pretreatment.

3. The process according to claim 2, wherein the nitrate-nitrogen content of the tobacco constituents is degraded incompletely in the first fermenter, and the extract is subsequently treated in the second fermenter.

4. The process according to claim 1 or 2, wherein the extract continuously supplied to the first fermenter has a nitrate-nitrogen concentration of 0.6 to 1.7 $g.l^{-1}$, a phosphate concentration of 1.0 to 10 $g.l^{-1}$ and a carbon source concentration of $16.5 \pm 10$ assimilable carbon atoms per nitrate molecule and is added to the first fermenter at a dilution rate of 0.1 to 0.35 $l.l^{-1}.h^{-1}$ while exponential growth conditions for the degrading micro-organisms are maintained by aeration with 0.8 to 2.5 $l.l^{-1}.min.^{-1}$, pH adjustment in the range of 3.5 to 6, and warming to a temperature range of 25° to 37° C., the volume of the contents of the first fermenter being kept constant by continuous removal of treated extract together with the corresponding biomass.

5. The process according to claim 1 or 2, wherein the biomass is separated from the finally treated extract.

6. The process according to claim 1 or 2, wherein degradation is effected by micro-organisms selected from the group consisting of *Candida utilis* (NCYC 707), *Candida berthetii* (CBS 5452), *Candida utilis* (NCYC 321), *Candida utilis* (NCYC 359) and *Enterobacter aerogenes* (ATCC 13048).

7. The process according to claim 2, wherein the nitrate-nitrogen content of the tobacco constituents is degraded incompletely in the first fermenter and the extract is mixed with untreated extract in a ratio of up to 1:5 and the extract mixture is subsequently treated in the second fermenter.

8. The process according to claim 2, wherein the nitrate-nitrogen content of the tobacco constituents is completely degraded in the first fermenter, the extract so treated is mixed with untreated extract in a ratio of 5:1 to 1:5 and the resulting mixed extract is treated in the second fermenter.

9. The process according to claim 1 or 2, wherein the second fermenter is operated continuously by feeding the extract to the fermenter at a dilution rate of 0.05 to 0.35 $l.l^{-1}.h^{-1}$ and keeping the volume of the contents of the second fermenter constant by the continuous removal of treated extract together with the corresponding biomass.

10. The process according to claim 1 or 2, wherein the second fermenter is filled with extract, then left for up to 24 hours with agitation, and thereafter emptied and charged with a fresh quantity of extract.

11. The process according to claim 1 or 2, wherein the second fermenter is slowly filled with the extract by continuous, uniform feed and, when it has been filled, is then rapidly emptied.

* * * * *